US006202269B1

(12) United States Patent
Specht et al.

(10) Patent No.: US 6,202,269 B1
(45) Date of Patent: Mar. 20, 2001

(54) SEAT BELT BUCKLE

(75) Inventors: Martin Specht, Feldafing; Walter Krauss, München; Stephan Schwald, Seefeld; Thomas Schrott, Feldafing, all of (DE)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/366,142

(22) Filed: Aug. 3, 1999

(30) Foreign Application Priority Data

Dec. 18, 1998 (DE) ..... 198 58 716

(51) Int. Cl.[7] ..... A44B 11/26

(52) U.S. Cl. ..... 24/641; 24/633; 24/645; 24/651

(58) Field of Search ..... 24/641, 633, 651, 24/636, 637, 645

(56) References Cited

U.S. PATENT DOCUMENTS

| | | | | |
|---|---|---|---|---|
| 5,008,989 | * | 4/1991 | Wedler et al. | 24/641 |
| 5,195,224 | * | 3/1993 | Bock et al. | 24/641 |
| 5,704,099 | * | 1/1998 | Cahill | 24/633 |
| 5,765,266 | * | 6/1998 | Betz | 24/633 |

FOREIGN PATENT DOCUMENTS

| | | |
|---|---|---|
| 3342783 | 10/1987 | (DE) . |
| 0212507 | 8/1986 | (EP) . |
| 0777984 | 12/1996 | (EP) . |

* cited by examiner

*Primary Examiner*—Victor N. Sakran
(74) *Attorney, Agent, or Firm*—Lonnie Drayer

(57) ABSTRACT

A buckle for a seat belt has an interlock that provides impact resistance between an ejector and a support for a securing element for securing the locked state, the interlock being maintained during the retensioning process.

6 Claims, 3 Drawing Sheets

SEAT BELT BUCKLE

FIELD OF THE INVENTION

The invention relates to a seat belt buckle.

DISCUSSION OF THE PRIOR ART

EP 0 777 984 A2 teaches a buckle with a guide channel in a buckle frame, into which a plug-in tongue connected to the seat belt can be inserted. An ejector is guided in a guide channel and is acted on by an ejector spring in a direction opposite the insertion direction of the plug-in tongue. A locking element is mounted on the buckle frame and can be moved into a locking position for locking the plug-in tongue inserted into the guide channel, and into a release position for releasing the plug-in tongue. A securing element can be moved into a securing position for fixing the locking element in a locking position, and into a disengaging position for releasing the locking element is also movably mounted on the buckle frame. A support is also provided with which the securing element is held in the securing position in the case of excessive acceleration and/or deceleration. This ensures that the securing element remains in its securing position even with high acceleration and/or deceleration of the buckle, for example during retensioning of the buckle by means of a buckle tightener acting on the buckle. The locking element is thus held in its locking position so that the seat belt is tightened in the desired manner.

In the acceleration phase of the retensioning process, the securing element is held in the securing position as a result of its inertia and the inertia of the support. During deceleration, a compensating mass, which is guided longitudinally in the guide channel on the buckle frame, acts via a lever arm and the support on the securing element and holds it in the securing position. The ejector is supported on the compensating mass via the ejector spring.

EP 0 212 507 teaches a seat belt buckle having a compensating mass mounted on a lever arm which acts on a securing element in the acceleration phase of the retensioning process. In the deceleration phase, however, the lever on which the compensating mass is mounted is lifted as a result of the inertia of the compensating mass which strives to move on in the direction of the acceleration phase of the tensioning process, such that an absolutely secure holding of the securing element in the securing position is no longer ensured by the compensating mass.

SUMMARY OF THE INVENTION

It is an object of the invention to provide, at reduced cost, a seat buckle that absolutely secures the securing element in the securing position even in the deceleration phase of the retensioning process.

The invention provides an interlocking fit between the support and the ejector. For example, the support and ejector rest against one another with a load-bearing pair of active surfaces. Surface pressure can be provided, for example by spring force, on the two active surfaces of the support and the ejector. When subjected to force, for example during acceleration, deceleration or retensioning of the buckle, the masses of the support and of the ejector generate forces of inertia in the same direction by means of which the securing element is supported in its securing position on the frame. The interlock is maintained during acceleration and deceleration and the support on the frame ensures that all movable parts of the buckle are supported on the buckle frame in a motionless manner in all degrees of freedom, in particular on corresponding abutments of the buckle frame. This ensures that, even with high accelerations and decelerations at up to 7,000 times the acceleration due to gravity and higher, all movable components of the buckle are secured to such an extent that opening of the buckle is completely prevented. The kinematics of the buckle prevents unintentional opening in the event of a severe crash.

The interlocking fit between support and ejector is maintained at least during deceleration of the retensioning movement. It is preferably maintained during the retensioning movement. However, it can be produced during insertion of the plug-in tongue into the guide channel. Furthermore, the interlock between the ejector and the support can be produced during insertion of the plug-in tongue into the guide channel by the insertion of the ejector into the guide channel, the support being moved by this interlock into a standby position for supporting the securing element in the securing position on the buckle frame, in particular on an abutment fastened on the buckle frame.

In the locking position, the mutually interlocked support and ejector can be movably mounted under the influence of their forces of inertia in each case in the same direction on the buckle frame along a limited path in which the securing element remains in its securing position between two stationary abutments. In the locking position during normal operation, however, the securing element is preferably pressed without movement against one of the two stationary abutments of the buckle frame under the influence of a biasing force preferably supplied by a spring. The securing element remains in this position even during the acceleration phase of the retensioning movement as a result of the influence of the inert masses of the securing element and the support.

The path along which the support and the ejector are movably mounted and, in particular, are moved in the deceleration phase of the retensioning process, is limited by a stationary abutment, in particular fastened on the buckle frame. The securing element is immovably supported in all degrees of freedom on this abutment within its securing position via the support. The rigid connection which is maintained due to the interlock between the support and the ejector even during common movement ensures that the support comes into the position supported on the buckle frame immovable in all degrees of freedom in the deceleration phase. During this movement, the support and the ejector and the securing element are guided rectilinearly, in particular parallel, to the direction of the guide channel.

The support can comprise an abutment part that can be supported directly on the buckle frame, in particular on the abutment, in the deceleration phase of the retensioning process. The abutment part can be supported in such a way that it is immovable in all degrees of freedom. The abutment part can be provided at one end of the elongate support and the securing element can be arranged at the other end. The securing element can be designed in the form of a cylindrical bolt that is guided at both its ends in slots extending substantially parallel to the guide direction of the guide channel. The securing element extends in a known manner transversely to the insertion or ejection direction of the plug-in tongue.

One end of the guide slot, provided on both sides of the buckle frame in each case, for the securing element can form the abutment during the acceleration phase of the retensioning process for the securing element. The support can also be supported on this abutment via the securing element on the buckle frame. The mass of the ejector is supported in the acceleration phase of the retensioning process via the plug-in tongue on the locking element located in its locking position.

In the securing position, the securing element fixes the locking element in its locking position, the locking element engaging in the plug-in tongue inserted into the guide channel. In the region of the securing position, the securing element lies along a securing surface provided on the locking element with a corresponding securing contour as known, for example, from EP 0 777 984 A2.

The support can pivot around an axis formed by the securing element that is, for example, cylindrical. The pair of active surfaces on the support and on the ejector, forming the interlock, can be located within radial cams provided on the support and the pair of ejectors. These radial cams can interact, in particular during insertion of the plug-in tongue into the guide channel, such that the support is brought into the above-mentioned standby position, in particular for the impact-resistant support of the securing element in the securing position during the deceleration phase of the retensioning process. The standby position can be located at the beginning of the limited path for the movement of the connection consisting of support, securing element and ejector.

BRIEF DESCRIPTION OF THE DRAWINGS

An embodiment of the invention will be described in more detail hereinafter with reference to the figures.

DETAILED DESCRIPTION OF THE INVENTION

Figure 1:
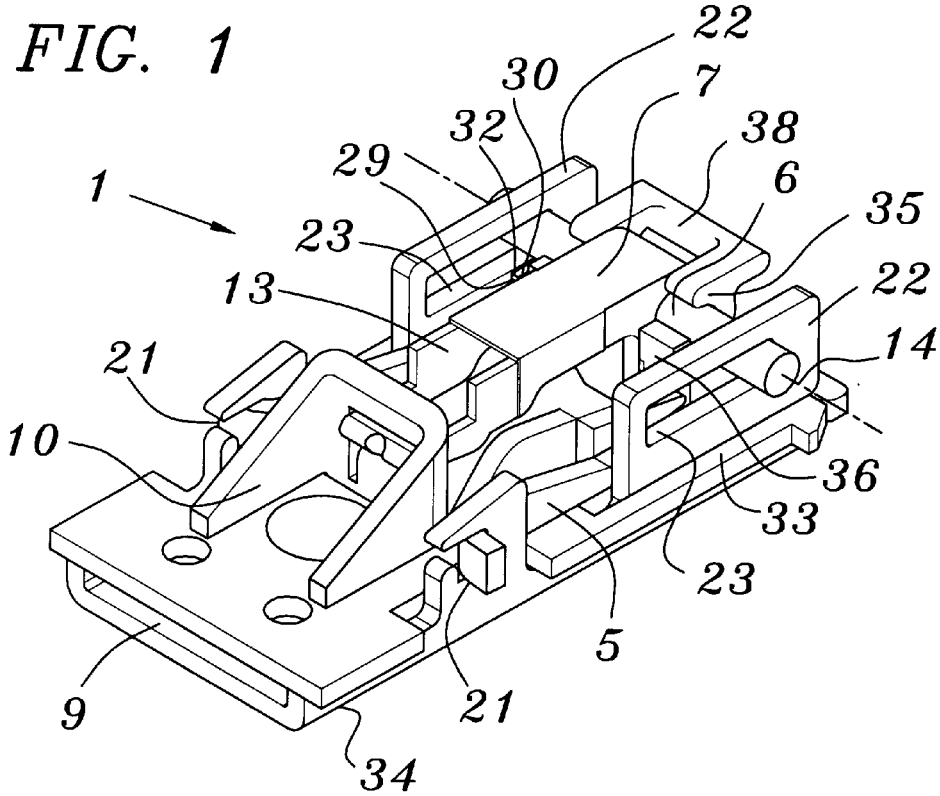
FIG. 1 is a perspective view of the embodiment in the locking position.

The embodiment of the buckle for a seat belt shown in the figures possesses a guide channel 2 in a buckle frame 9 which can be formed in a known manner by an upper and a lower plate 33, 34. An ejector 3 loaded in the ejection direction by an ejector spring 4 is guided longitudinally in the guide channel. The ejector spring is supported at one end on a holder 41 rigid with the frame. A locking element 5 is pivotally mounted on the buckle frame 9, for example on the upper plate 33, in a drag bearing 21 of the type known, for example, from EP 0 777 984 A2. The locking element 5 can be moved between a release position (FIGS. 2 and 4) and a locking position (FIGS. 1, 5 and 6), as will be described in more detail. In the locking position, shown in FIGS. 1, 5 and 6, the locking element 5 is fixed by a securing element 6. The securing element can be in the form of a cylindrical bolt, which is guided on both sides in slots 23 in frame members 22 shaped, for example, on the lower plate 34 and extending perpendicularly thereto. The slots extend substantially parallel to the guide channel 2. The securing element is therefore guided parallel to the guide channel 2 on the lateral frame members.

A support 7 is connected to the securing element 6. The support can pivot around an axis 14 formed by the securing element. The support can be non-rotatably connected to the securing element, which has a cylindrical configuration at least in the region of engagement with the slots 23. However, it is also possible to arrange the securing element rotatably in the support 7. The securing element is preferably mounted radially in the support, in an immovable or rigid manner. The support moves together with the securing element.

On the side facing the ejector 3, the support 7 possesses a radial cam 15 that faces a radial cam 16 on the ejector. The radial cams 15, 16 interact on insertion of the plug-in tongue 12 into the guide channel 2, as will be described in detail below.

The support 7 is biased by the bias of a spring 24 in a pivoting direction around the axis 14 in which an abutment part 13 provided at the end of the support has disengaged from an abutment 10 fastened on the frame. The spring is supported at one end on the buckle frame 9, for example in the region of the abutment 10, rigid with the frame and acts at the other end via a lever arm 25 on the support 7 so that the described bias and moment around the axis 14 of the support is applied.

Figure 2:
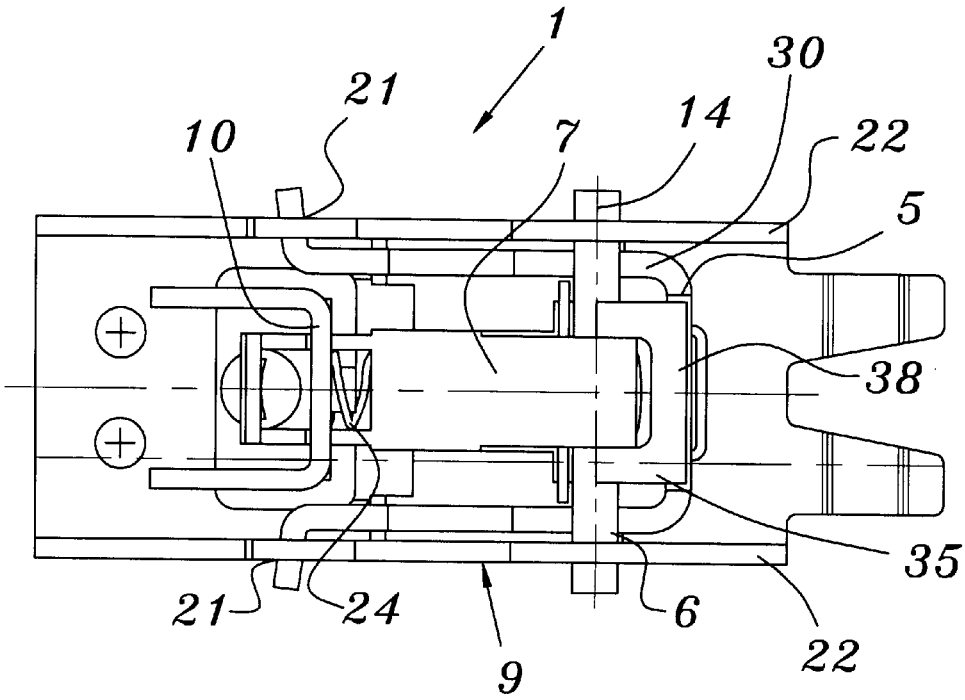
FIG. 2 is a plan view of the embodiment in the release position.
Figure 3:
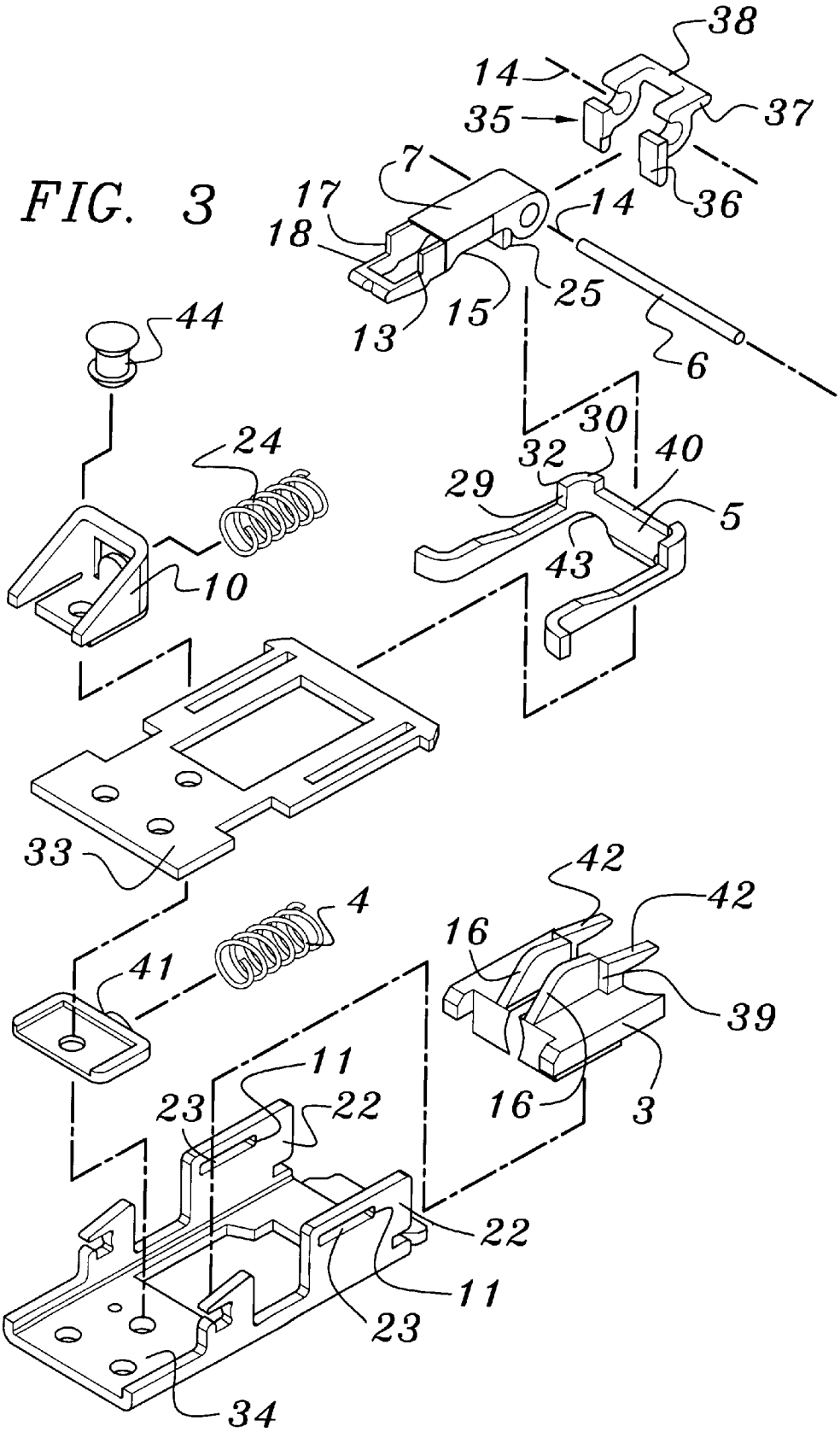
FIG. 3 is an exploded view of the individual parts of the embodiment.
Figure 4:
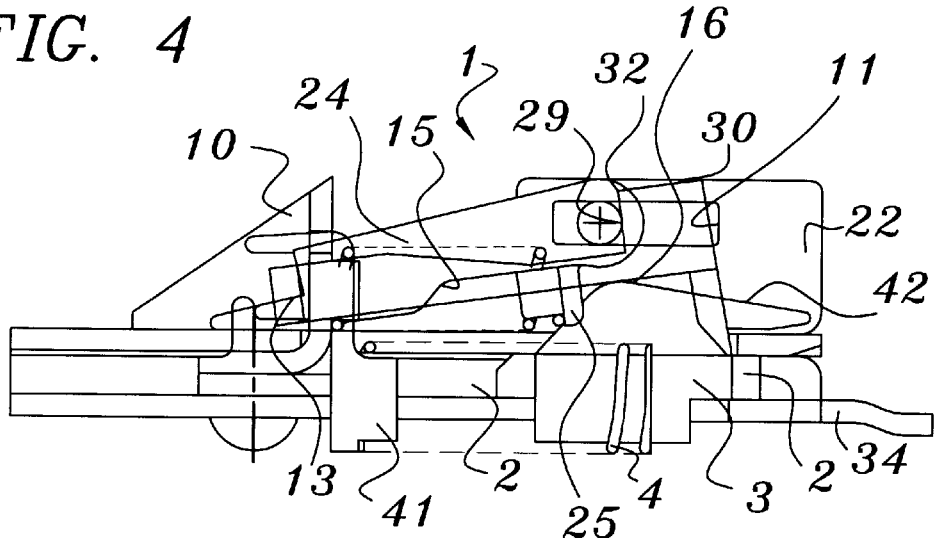
FIG. 4 is a longitudinal section of the embodiment of the buckle in the release position.

The support 7 adopts this position, in which the abutment part 13 on the support is disengaged from the abutment 10, when the locking element 5 is located in the release position (FIGS. 2 and 4). The plug-in tongue 12 is disengaged from the buckle 1 in this release position.

Upon insertion of the plug-in tongue 12 into the guide channel 2, an actuating lever 35, which is pivotally mounted around the axis 14 on the securing element 6, is pivoted by an entraining surface 39 provided on the ejector 3. For this purpose, the entraining surface acts upon a lever arm 36 of the actuating lever. During this pivoting movement, the actuating lever acts via its second lever arm 37 on an upper edge 40 of the locking element 5 with a connecting link 38 which interconnects the two pairs of levers 36, 37 on either side of the support 7. The locking element is thus introduced downwards into the locking position through locking recesses 27, 28 in the plug-in tongue 12 and the two plates, as also described in EP 0 777 984 A2. The locking element 5 then comes into the position shown in FIG. 5, with an engagement part 26. In this position, the engagement part engages in the locking recess 27 on the plug-in tongue 12 and projects further through the locking recesses 28 in the two plates 33, 34 of the buckle frame 9.

Figure 5:
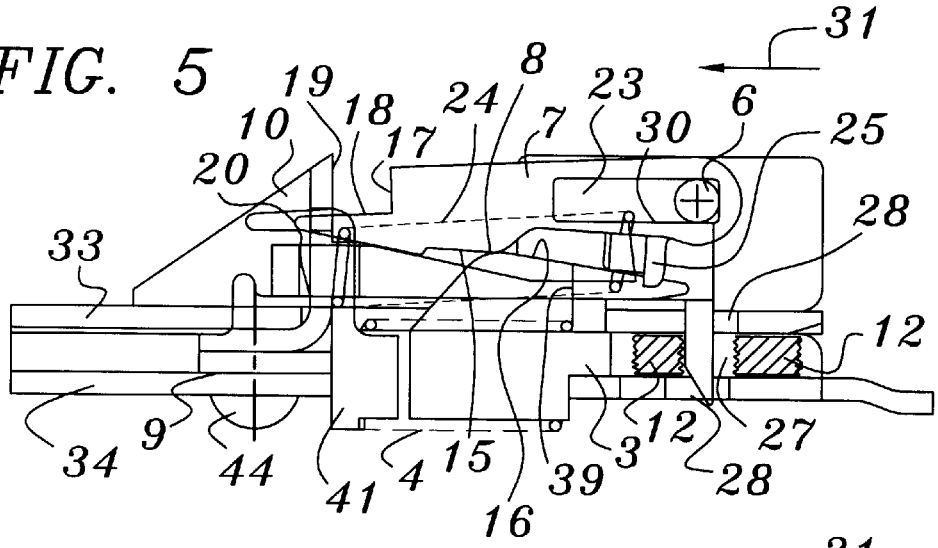
FIG. 5 is a longitudinal section of the embodiment in the locking position, showing the movable parts of the buckle in the positions which they adopt during normal operation or in the acceleration phase of the retensioning process.

During this movement, a release abutment surface 29 on which the securing element 6 rests in the release position (FIG. 4) on the locking element 5 is also moved so that a securing abutment surface 30 also formed on the locking element with a corresponding impact-resistant contour or impact-resistant length moves beneath the securing element 6. The securing element is then slid around an edge 32 via the securing abutment surface 30 as a result of the biasing force of the spring 24 acting upon the support 7 and therefore upon the securing element. As a result of the biasing force of the spring 24, the support and the securing element are displaced so far that the securing element rests on the end of the longitudinal slot 23 forming an abutment 11 on the buckle frame 9 or on the frame member 22 (FIGS. 1 and 5).

During insertion of the plug-in tongue 12 into the guide channel 2, the radial cam 16 provided on the ejector 3 comes into contact with the radial cam 15 provided on the support 7. A moment around the axis 14 is thus exerted on the support 7 against the force of the spring 24. During this displacement movement, the end of the support on which the abutment part 13 is provided is raised and is then located in the standby position shown in FIG. 5. The support is brought into the standby position by the interlocking fit between the ejector 3 and the support, as described above. The two radial cams 15, 16 shaped on the support and the ejector 3 act on the support as a load-bearing pair of active surfaces during transmission of the insertion movement of the ejector 3 onto the support. In the standby position 8, an interlock is maintained between the support 7 and the ejector 3 in the region of the radial cams 15, 16. The pair of active surfaces in the region of the interlock 8 maintained by the biasing force of the spring 24 ensures that the support 7 is kept in the standby position.

The securing element 6 on the abutment 11 rigid with the frame is also in this standby position during normal operation of the buckle 1, as already described. The securing element ensures that the locking element 5 is fixed with its engagement part 26 in the locking position. The securing element maintains this securing position even when the buckle is pulled back by means of a buckle tightener to tighten the belt. In the acceleration phase of this retensioning process, which takes place in the direction of the arrow 31 in FIGS. 5 and 6, the securing element 6 and the support 7 are pressed, on account of their inert masses, against the end of the slot 23 forming the abutment 11 rigid with the frame. The ejector 3 is pressed against the front end of the plug-in tongue 12 inserted into the guide channel 2. All movable parts of the buckle therefore remain motionless in the locking position shown in FIG. 5.

Figure 6:
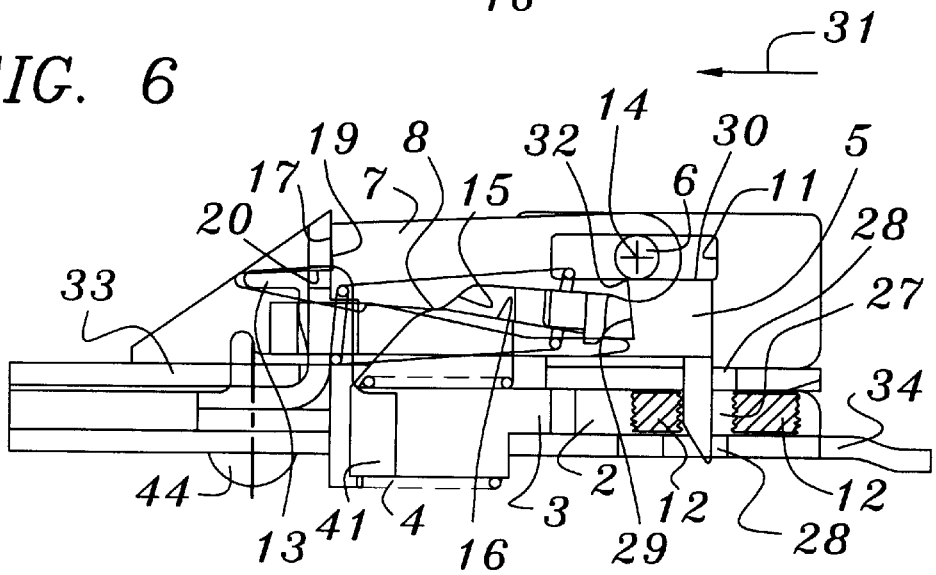
FIG. 6 is a longitudinal section of the embodiment in the locking position in which the movable parts of the belt buckle have adopted the position in the deceleration phase of the retensioning process.

In the deceleration phase of the retensioning process, the movable parts of the buckle 1, i.e. the ejector 3, the securing element 6 and the support 7, attempt to continue moving in the retensioning direction (arrow 31) due to their inert masses. The ejector 3 and the support are displaced together with the securing element in the retensioning direction (arrow 31) until the support with its abutment part 13 strikes the abutment 10 rigid with the frame (FIG. 6). During this common movement, the interlocking fit at the position 8 between the ejector 3 and the support is maintained. The support 7 therefore maintains its position raised on the abutment part 13 so that an abutment surface 17 on the support comes into contact with a corresponding abutment surface 19 on the abutment 10 rigid with the frame. Forces directed substantially parallel to the guide channel 2 due to the inert mass of the support and of the securing element 6 are thus taken up by the abutment 10 and the buckle frame 9.

The abutment part 13 of the support 7 also possesses an abutment surface 18 which extends substantially perpendicularly to the abutment surface 17 and comes to rest in the deceleration phase with a corresponding abutment surface 20 on the abutment 10 rigid with the frame. Forces which act upon the support and are directed substantially perpendicularly to the course of the guide channel 2 are thus taken up by the abutment 10 and therefore by the buckle frame.

In the position in which the abutment part 13 at one end of the support 7 strikes the abutment 10 rigid with the frame (FIG. 6), it is ensured that the securing element 6 at the other end of the support 7 is still located on the securing abutment surface 30 of the locking element 5. The securing abutment surface 30 extends substantially parallel to the length of the guide channel 2 and the slot 23. This ensures that, even in the deceleration phase of the retensioning process, the securing element is located in its securing position and the locking element is fixed in its locking position (FIG. 6). As already described, the ejector 3 is moved back in the direction of the retensioning movement (arrow 31) by the front end of the plug-in tongue 12 due to its inertial mass against the force of the ejector spring 4 so that the interlocking fit at the point 8 with the support 7 is maintained. This ensures that the abutment part 13 of the support is held in the desired raised position so that the abutments 17, 18 are able to interact with the corresponding abutments 19, 20 of the abutment 10 rigid with the frame. This ensures that, even in the deceleration phase of the retensioning process, all movable parts of the buckle remain immovable in all degrees of freedom so that absolute impact resistance is maintained even at high accelerations which can amount to 7,000 times the acceleration due to gravity and higher.

To return the buckle into its release position (FIG. 4) the securing element 6 is displaced so far in the slot 23 in a known manner by a push-button (not shown in detail) that it is moved beyond the edge 32 in which the securing abutment surface 30 and the release abutment surface 29 converge. After this disengaging operation, the locking element 15 is removed from the locking recesses 27, 28. This can be effected by control surfaces accordingly arranged on the push-button and the locking element 5. In the embodiment illustrated, a lifting movement into the unlocked position (FIG. 4) is transmitted to the disengaged and therefore released locking element 5 by unlocking control surfaces 42 which are provided on the ejector 3 and extend obliquely upwards in the ejection direction. The unlocking control surfaces 42 act on lower edges 43 of the locking element 5.

EP 0 777 984 A2 discloses a method of moving the locking element into the release position by means of the ejector moved in the ejection direction. The securing element 6 comes to rest on the release abutment surface 29 on the locking element 5 and is pressed against the release abutment surface 29 by the force of the spring 24. This ensures that the locking element is held in the release position (FIG. 4). The support 7 is simultaneously pivoted around the axis 14 formed by the securing element 6 by the action of the spring 24 so that the abutment part at the other end of the support is moved downwards and is inserted into a corresponding recess of which the upper limit is the abutment surface 20.

When the plug-in tongue 12 is released by the locking element 5 it is removed from the guide channel 2 by the ejector 3 as a result of the action of the ejector spring 4 resting on the buckle frame 9 on the holder 41 fastened by a bolt 44.

With the invention, as described above, absolute impact-resistant locking is invariably ensured during the tensioning process, due to the interlock between the support 7 and the ejector 3 in cooperation with the forces of inertia which occur in the acceleration phase and deceleration phase and act on the movable parts of the buckle.

The forces of inertia derived from the masses of the movable parts already required on the buckle, namely the ejector 3, the support 7 and the securing element 6, in combination with the interlocking fit 8 between the ejector and the support and the abutments 10, 11 rigid with the frame are utilized in that the securing element can move only along a specific path during the tensioning process. On the abutments 10, 11 rigid with the frame, the support of the movable components which is absolutely immovable in all degrees of freedom is ensured during the acceleration phase and the deceleration phase of the tensioning process. The locking element 6 always rests on the securing abutment surface 30 on the locking element 5 so that it is held absolutely securely in the locking position both in the acceleration phase and in the deceleration phase.

Although the present invention has been disclosed in connection with a few preferred embodiments thereof, variations and modifications may be chosen by those skilled in the art without departing from the principles of the invention. All of these variations and modifications are considered to be within the spirit and scope of the present invention as disclosed in the foregoing description and defined in the appended claims.

We claim:

1. A seat belt buckle comprising:

a buckle frame having a guide channel formed therein into which a plug-in tongue connected to a seat belt can be inserted, an ejector which is guided in the guide channel and on which an ejector spring acts in an ejection direction against an insertion direction of the plug-in tongue, a locking element which is mounted on the buckle frame and can be moved into a locking position for locking the plug-in tongue inserted into the guide channel, and into a release position for releasing the plug-in tongue, a securing element which can be moved into a securing position for fixing the locking element in the locking position and into a disengaging position for releasing the locking element, and a support with which the securing element is held in the securing position in cases of excessive acceleration and deceleration, an interlocking fit is provided between the support and the ejector in the locking position, and on acceleration and deceleration the masses of the support and the ejector generate forces of inertia in the same direction, by means of which the securing element is supported on the buckle frame in its securing position, the interlock between support and ejector when retensioning acceleration and retensioning deceleration act upon the buckle is immovably supported on a stationary abutment, in particular fastened on the buckle frame.

2. A seat belt buckle comprising:

a buckle frame having a guide channel formed therein into which a plug-in tongue connected to a seat belt can be inserted, an ejector which is guided in the guide channel and on which an ejector spring acts in an ejection direction against an insertion direction of the plug-in tongue, a locking element which is mounted on the buckle frame and can be moved into a locking position for locking the plug-in tongue inserted into the guide channel, and into a release position for releasing the plug-in tongue, a securing element which can be moved into a securing position for fixing the locking element in the locking position and into a disengaging position for releasing the locking element, and a support with which the securing element is held in the securing position in cases of excessive acceleration and deceleration, an interlocking fit is provided between the support and the ejector in the locking position, and on acceleration and deceleration, the masses of the support and the ejector generate forces of inertia in the same direction, by means of which the securing element is supported on the buckle frame in its securing position, in the locking position, the mutually interlocked support and ejector are movably mounted under the influence of their forces of inertia in the same direction on the buckle frame along a limited path in which the securing element remains in the securing position between two abutments rigid with the frame.

3. A seat belt buckle comprising:

a buckle frame having a guide channel formed therein into which a plug-in tongue connected to a seat belt can be inserted, an ejector which is guided in the guide channel and on which an ejector spring acts in an ejection direction against an insertion direction of the plug-in tongue, a locking element which is mounted on the buckle frame and can be moved into a locking position for locking the plug-in tongue inserted into the guide channel, and into a release position for releasing the plug-in tongue, a securing element which can be moved into a securing position for fixing the locking element in the locking position and into a disengaging position for releasing the locking element, and a support with which the securing element is held in the securing position in cases of excessive acceleration and deceleration, an interlocking fit is provided between the support and the ejector in the locking position, and on acceleration and deceleration, the masses of the support and the ejector generate forces of inertia in the same direction, by means of which the securing element is supported on the buckle frame in its securing position, in the locking position during normal operation and the acceleration phase of the retensioning process the securing element is pressed against an abutment on the buckle frame and is thus held in the securing position.

4. A seat belt buckle comprising:

a buckle frame having a guide channel formed therein into which a plug-in tongue connected to a seat belt can be inserted, an ejector which is guided in the guide channel and on which an ejector spring acts in an ejection direction against an insertion direction of the plug-in tongue, a locking element which is mounted on the buckle frame and can be moved into a locking position for locking the plug-in tongue inserted into the guide channel, and into a release position for releasing the plug-in tongue, a securing element which can be moved into a securing position for fixing the locking element in the locking position and into a disengaging position for releasing the locking element, and a support with which the securing element is held in the securing position in cases of excessive acceleration and deceleration, an interlocking fit is provided between the support and the ejector in the locking position, and on acceleration and deceleration, the masses of the support and the ejector generate forces of inertia in the same direction, by means of which the securing element is supported on the buckle frame in its securing position, in the locking position, the mutually interlocked support and ejector are guided rectilinearly, in particular parallel, to the direction of the guide channel on the buckle frame, in particular at the transition from the acceleration phase to the deceleration phase of the retensioning process on the buckle frame.

5. A seat belt buckle comprising:

a buckle frame having a guide channel formed therein into which a plug-in tongue connected to a seat belt can be inserted, an ejector which is guided in the guide channel and on which an ejector spring acts in an ejection direction against an insertion direction of the plug-in tongue, a locking element which is mounted on the buckle frame and can be moved into a locking position for locking the plug-in tongue inserted into the guide channel, and into a release position for releasing the plug-in tongue, a securing element which can be moved into a securing position for fixing the locking element in the locking position and into a disengaging position for releasing the locking element, and a support with which the securing element is held in the securing position in cases of excessive acceleration and deceleration, the support comprising an abutment part which can be immovably supported directly on the buckle frame, in particular on an abutment rigid with the frame, in all degrees of freedom, an interlocking fit is provided between the support and the ejector in the locking position, and on acceleration and deceleration, the masses of the support and the ejector generate forces of inertia in the same direction, by means of which the securing element is supported on the buckle frame in its securing position.

6. The seat belt buckle according to claim 5 wherein the abutment part is provided with at least two abutment surfaces by means of which forces acting substantially parallel and perpendicular to the guide channel on the securing element and the support can be supported on the buckle frame.

* * * * *